United States Patent [19]

Majors

[11] 4,229,061

[45] Oct. 21, 1980

[54] ELECTRICAL ADAPTER OR CONNECTOR

[76] Inventor: James P. Majors, 19515 Frederick Rd., Germantown, Md. 20676

[21] Appl. No.: 34,451

[22] Filed: Apr. 30, 1979

[51] Int. Cl.[3] ..... H01R 13/14; H01R 13/24

[52] U.S. Cl. ..... 339/64 M; 339/49 B; 339/255 R; 339/272 R

[58] Field of Search ..... 339/48, 49 B, 64 R, 339/64 M, 255 R, 272 R

[56] References Cited

U.S. PATENT DOCUMENTS

| | | | |
|---|---|---|---|
| 2,658,182 | 11/1953 | Jackson et al. | 339/64 M |
| 3,678,442 | 7/1972 | Cope et al. | 339/255 R |

FOREIGN PATENT DOCUMENTS

| | | | |
|---|---|---|---|
| 2262393 | 6/1974 | Fed. Rep. of Germany | 339/225 R |
| 538043 | 1/1956 | Italy | 339/255 R |
| 688458 | 3/1965 | Italy | 339/255 R |
| 211619 | 5/1968 | U.S.S.R. | 339/255 R |
| 482037 | 6/1976 | U.S.S.R. | 339/255 R |

*Primary Examiner*—Neil Abrams

*Attorney, Agent, or Firm*—Haight, Rosfeld, Noble & Santa Maria

[57] ABSTRACT

An electrical adapter or connector (10) comprises a block of insulating material (12) and a plurality of moveable contact pins (16) which are positioned within recesss (14) found in the block. Each of the pins includes an upper mating electrical contact surface (18) and a screw (22) for conductively securing the pin to a wire (30). Springs (28) are loosely positioned at the bottom of each of the recesses in order to continuously bias the pins outwardly from the upper surface (15) of the insulating block. The pins are prevented from moving out of the recesses by set screws (32) placed within longitudinal bores (31) of the block or by attaching each spring at one end to the bottom of one recess and at its opposed end to the bottom of a contact pin. Each upper mating contact surface (18) is preferably conically shaped, so as to receive a mating contact pin (17) having a complimentary shaped conical surface (19) in aligned electrical engagement. This self-aligning feature permits the adapter to be easily installed in generally inaccessible positions within electrical systems. Replacement of defective complimentary shaped contact elements is facilitated as the necessary wiring can be secured to the adapter rather than to replaceable electrical components. Alternate embodiments of the moveable pins include upper mating contact surfaces which can be formed as either flat, discoidal surfaces (54) or clip-type contacts (62).

1 Claim, 10 Drawing Figures

FIG. 1
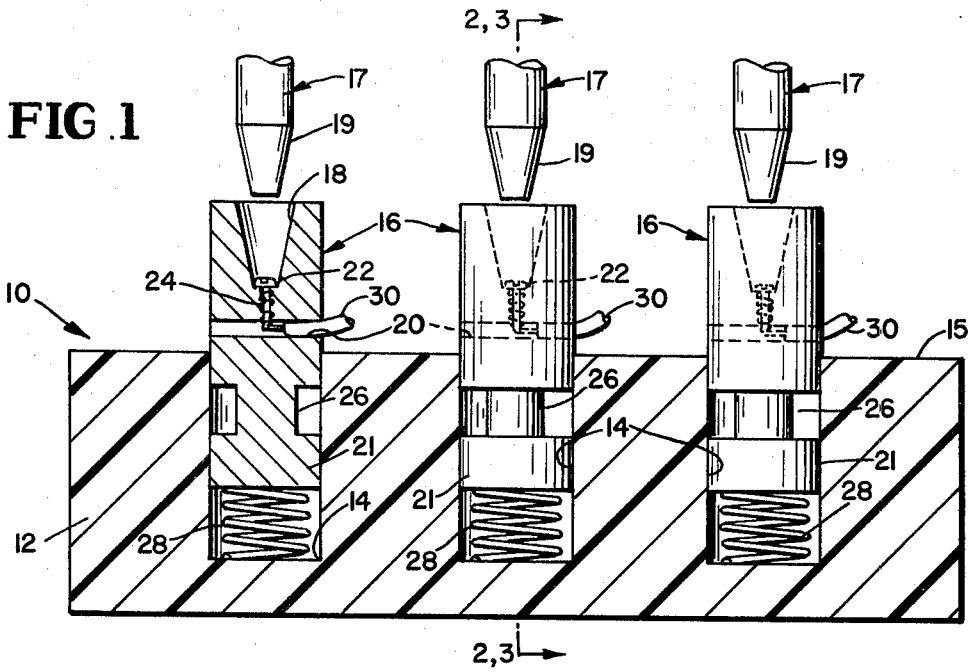
FIG. 2
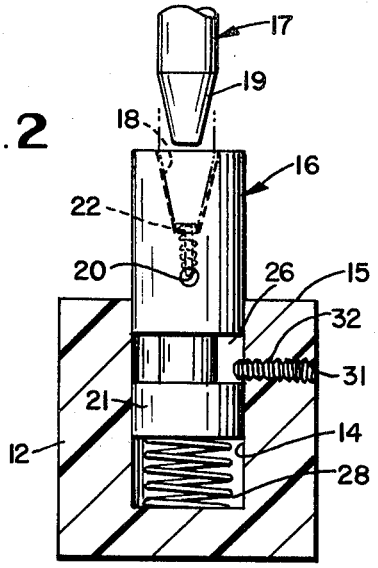
FIG. 3
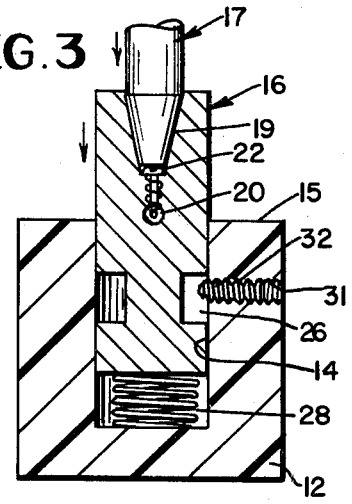
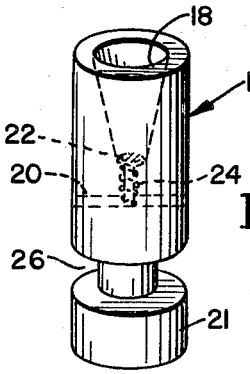
FIG. 4
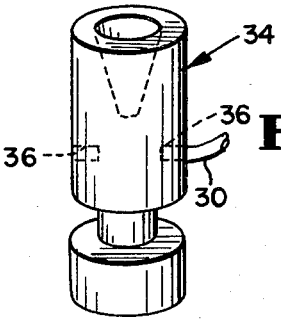
FIG. 5

FIG. 6
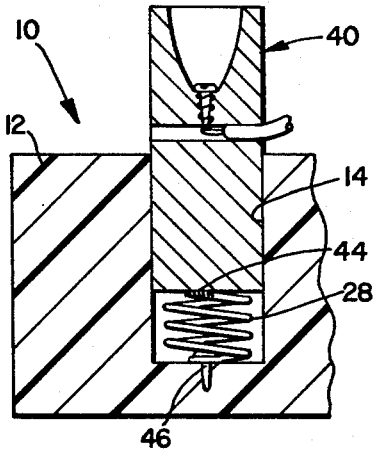
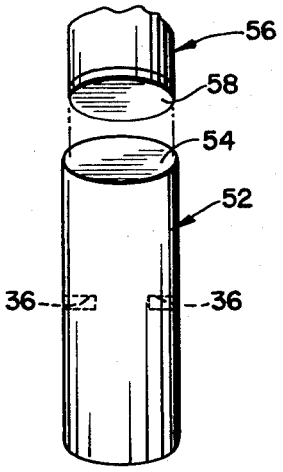
FIG. 7
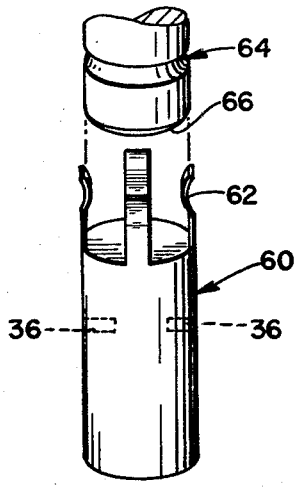
FIG. 8
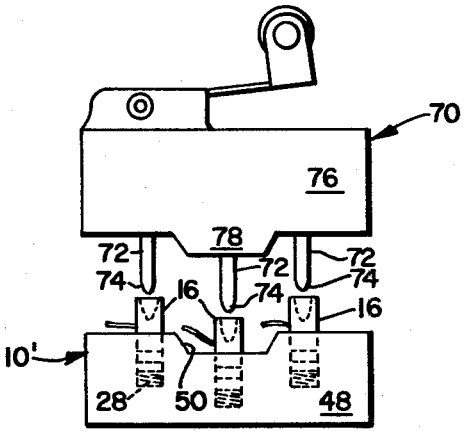
FIG. 9
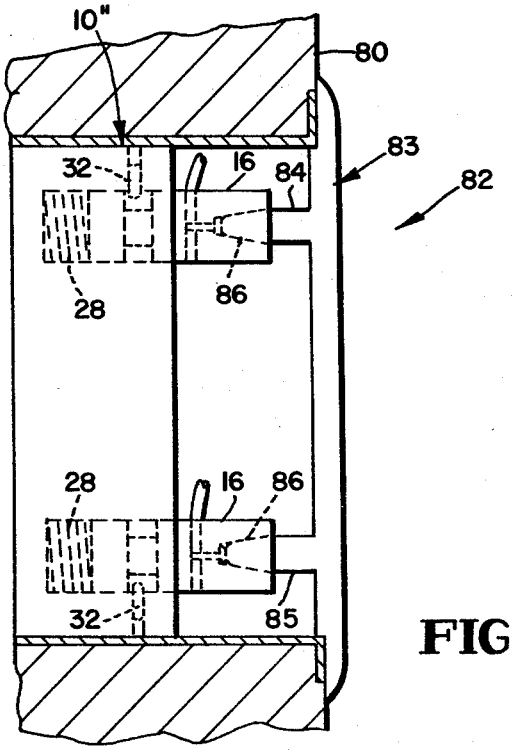
FIG. 10

ELECTRICAL ADAPTER OR CONNECTOR

BACKGROUND OF THE INVENTION

The present invention relates generally to an electrical adapter or connector, and more particularly to a new and improved electrical adapter for providing an aligned and certain electrical connection between complimentary shaped electrical contacts.

Many problems typically arise during the installation of conventional electrical contacts, particularly during replacement when the contacts are found to be defective. One problem is that the wires leading into one set of contacts must be disconnected prior to the insertion of new electrical contacts and then reconnected, which necessitates the use of various tools in areas which are generally small and inaccessible. This in turn requires a significant degree of expertise on the part of the person making a repair, which often causes undesirable delays in the continuous operation of electrical systems due to the general unavailability of skilled workmen near the systems. Furthermore, even such experienced labor will be required to spend an inordinate amount of time in the actual replacement of a defective electrical contact element. Another problem results from the inability of the repairmen to insure that an electrical connection between contact surfaces is as effective and certain as was the original connection; it is difficult to insure that the surfaces are properly aligned and in contact over a maximum surface area. A related problem is the inability of workmen to insure that the electrical contact surfaces are properly aligned when initially attached and that the resultant original electrical connection is as effective as desired.

Several attempts to overcome the aforementioned problems are disclosed in the prior art. For example, Collins et al., U.S. Pat. No. 2,742,626, disclose a multiple electrical connector designed to detachably connect a plurality of circuits. The connector comprises adjacent insulating blocks, each of which has a plurality of contact pins biased within bores located in the blocks. Although this connector insures accurate alignment and contact between the surfaces of mating electrical pins, it also requires that two adjacent blocks be securely fastened to one another by an unwieldly nut and bolt combination. Furthermore, the mating surfaces of the contact pins which are designed to receive complimentary conical contacts cannot be positioned beyond the upper surface of their associated insulating block.

Cope et al., U.S. Pat. No. 3,678,442, disclose an electric coupler for joining electric lines between adjacent railway cars. Although this coupler includes a plurality of biased conically shaped electrical contacts designed to snugly engage one another, it is quite large and cumbersome and is not designed to overcome the problems involved in the repair of malfunctions and defects in small electrical connections.

The connector of Redd et al., as illustrated by U.S. Pat. No. 3,363,220, does not overcome the problem of inferior electrical contact inherent in prior art connections. Although the connector includes a conical male plug biased into engagement with a conical female receiving plug, it does not create a superior electrical attachment by mating the plugs over the major portion of their respective surface areas. A workman could not insure a superior attachment by simply dropping a plurality of contacts into the connector, as the female plugs include no biasing elements which serve as means for aligning complimentary contacts into a desired position relative to each other.

Viola et al., U.S. Pat. No. 3,703,621, disclose a reciprocating conical switch assembly in which a plurality of spring loaded conical connectors are biased into connection with an equivalent number of bores. Although this assembly includes a number of complimentary shaped mating electrical contacts, they are part of a complex internal reversing switch arrangement and the assembly cannot be used to facilitate the creation of an aligned and certain external electrical connection.

The microswitch of Lyell, U.S. Pat. No. 3,277,249, is designed to minimize machine down time, shorten repair time and enable a switch to be repaired by a relatively unskilled laborer. Individual plug-in contact units are provided to replace any internal switch unit which may be defective. While this switch does disclose the general concept of repairing electrical units by simple replacement of individual elements, it does not provide a means for self-aligning electrical contacts and insuring certain electrical connection between complimentary shaped contact surfaces.

It is apparent that none of these prior art devices are capable of simply overcoming all of the aforementioned problems inherent in the installation and replacement of mating electrical contacts. All of these prior art devices are incapable of facilitating the repair of defective components and/or fail to provide an aligned and certain electrical connection between complimentary shaped contacts. None of these devices provides an electrical adapter or connector designed to receive a plurality of stationary electrical contacts in a manner which will insure superior electrical connection between contacts while permitting a layman to simply and quickly form such an attachment.

OBJECTS OF THE INVENTION

Accordingly, it is a general object of the present invention to provide a new and improved electrical adapter which facilitates the replacement of malfunctioning electrical contacts and insures superior electrical connections between the contacts.

Another object of the present invention is to provide a new and improved electrical adapter for minimizing the time needed to repair defective electrical connections by simply "dropping" a replacement contact element into the adapter to form a self-aligned and certain electrical connection.

A further object of the present invention is to provide a new and improved electrical adapter which will form a reliable and durable electrical connection by insuring a maximum mating surface area between complimentary shaped electrical contacts and by preventing dirt or dust from interfering with the same.

An additional object of the present invention is to provide a new and improved electrical adapter which can be simply replaced by both laborers and laymen having no electrical background and having only basic tools.

Upon further study of the specification and appended claims, further objects and advantages of this invention will become apparent to those skilled in the art.

SUMMARY OF THE INVENTION

Briefly, the above and other objects of the present invention are attained in one aspect thereof by providing an electrical adapter for facilitating the mating engagement of a plurality of electrical contacts. The adapter comprises a block of electrically insulating material having a plurality of recesses in its upper surface and electrically conductive contact pins positioned in at least two of the recesses. Each contact pin is biased outwardly from the upper surface of the block by a spring positioned beneath each pin at the bottom of each recess, and each pin includes an upper mating electrical contact surface and connecting means for securing a conductive wire to the pin. Associated with each recess and pin are means for retaining the pin in its recess, for limiting pin movement therein, and for continuously maintaining each contact surface and connecting means above the upper surface of the insulating block. When a plurality of complimentary shaped mating contacts are placed into engagement with the upper mating electrical contact surfaces, each pin is downwardly displaced until its associated spring reacts against said displacement to upwardly bias the pin toward its initial position and place the mating contacts into aligned and certain electrical connection with each other.

BRIEF DESCRIPTION OF THE DRAWINGS

The above and other objects, features and advantages of the present invention will be more fully apparent to those of ordinary skill in the art to which this invention pertains from the following detailed description when considered in connection with the accompanying drawings, in which like reference characters designate like or corresponding parts throughout the several views, and wherein:

FIG. 1 is a partial cross-section view of an electrical adapter or connector in accordance with the present invention illustrating the contact pins in their normal outwardly biased position.

FIG. 2 is a partial cross-section view of the electrical adapter or connector of FIG. 1 taken along line 2—2 illustrating a contact pin in its normal outwardly biased position as well as in its equilibrium position;

FIG. 3 is a partial cross-section view of the electrical adapter or connector of FIG. 1 taken along line 3—3 illustrating a contact pin downwardly displaced immediately after engagement with a mating contact pin;

FIG. 4 is a perspective view of one of the contact pins 16 of the electrical adapter or connector of FIG. 1;

FIG. 5 is a perspective view of a second embodiment of a contact pin which can be used as part of the electrical adapter or connector of FIG. 1;

FIG. 6 is a partial cross-section view of a third embodiment of a contact pin which can be used as part of the electrical adapter or connector of FIG. 1;

FIG. 7 is a perspective view of a fourth embodiment of a contact pin which can be used as part of the electrical adapter or connector of FIG. 1;

FIG. 8 is a perspective view of a fifth embodiment of a contact pin which can be used as part of the electrical adapter or connector of FIG. 1;

FIG. 9 is a plan view of an electrical adapter or connector in accordance with the present invention used in conjunction with a switch having complimentary shaped contacts; and FIG. 10 is a cross-sectional view of an electrical adapter or connector made in accordance with the present invention used in conjunction with a conventional wallplate.

DETAILED DESCRIPTION

Referring now to FIG. 1 of the drawings, an electrical adapter or connector 10 is illustrated which includes a block of insulating material 12. The block is preferably formed of non-conductive rubber or plastic, but could equally well be comprised of any other electrically insulating material. The block includes a plurality of generally cylindrical recesses 14 formed therein which extend to the upper surface 15 of block 12. In each of at least two of the recesses 14 are positioned moveable contact pins 16 which are normally biased outwardly from the upper surface 15 of the insulating block 12. Each of the contact pins 16 is generally cylindrical, matingly corresponding to the diameter of cylindrical recesses 14 and formed from electrically conductive material. Although adapter element 10 is shown having three contact pins 16, any desired number may be provided, depending upon the number of circuits desired to be completed. Cylindrical contact pins 16 each includes an upper mating electrical contact surface 18 which is shown in FIG. 1 as being of conical configuration. Each pin 16 further includes a longitudinal threaded bore 24 located adjacent the bottom of contact surface 18. The bore 24 receives and engages screw 22, providing electrical contact between a complimentary shaped mating contact 19 which can be inserted into pin 16 and a wire 30 which is also connected to the pin, as best illustrated by FIGS. 3 and 4. The screw-threaded bore 24 intersects a transverse wire-receiving bore 20 which extends along the full diameter of cylindrical pin 16. Wire 30 is inserted into bore 20 and the tip of screw 22 makes contact with the wire and conductively secures it to the pin. The inverted conical surface 18 matingly engages a complimentary shaped conical contact surface 19 which comprises the tip of a mating generally conical contact pin 17, as best shown in FIGS. 2 and 3. The extreme tip of conical contact pin 17 engages the top of screw 22 to form an electrical connection with wire 30 which engages the bottom of screw 22. The complimentary conical surfaces 18 and 19 provide maximum electrical and surface contact therebetween.

Each of cylindrical pins 16 is biased outwardly from the upper surface 15 of block 12 by a spring 28 which is loosely placed in the bottom of each recess. To prevent the pin from being completely displaced from the block 12, a set screw 32 is inserted in a longitudinal bore 31 through one side of the block, as illustrated by FIG. 2, in an area where cylindrical contact pin 16 has a circumferentially recessed surface 26. The set screw can thus extend into and be retracted from recess 14. In its normal, upwardly biased position, the bottom 21 of cylindrical contact pin 16 abuts set screw 32.

As illustrated in FIG. 3, when a mating conical contact pin 17 is dropped or inserted into moveable cylindrical contact pin 16, the cylindrical contact pin 16 is downwardly displaced so that the upper portion of pin recess 26 is adjacent to set screw 32. Although the pin is downwardly displaced by the positioning of conical contact pin 17 therein, in operation wire receiving bore 20 at all times remains above upper surface 15 of the insulating block, due to the presence of set screw 32 which limits the downward movement of cylindrical contact pin 16.

After conical contact pins 17 are dropped into moveable cylindrical contact pins 16, coil springs 28 return the pins 16, together with the mating pins 17 therein, to an equilibrium position which is the same as that of cylindrical contact pin 16 shown in FIG. 2. The position of conical contact pin 17 in the equilibrium position is illustrated by the dotted lines in FIG. 2. The combination of the outward force exerted by spring 28 and the complimentary conical configuration of contact surfaces 18 and 19 on cylindrical contact pin 16 and conical contact pin 17, respectively, insures the alignment of conical contact pins 17 with the pins of the adapter when they are simply dropped in or even placed carelessly into the adapter. This enables an unskilled worker to complete a desired electrical connection within a system without the need for tools, as it automatically insures maximum contact between electrical contact elements.

Alternative means to screw 22, screw threaded bore 24 and transverse extending wire receiving bore 20 can be provided for connecting a wire 30 to a moveable contact pin 16. As illustrated in FIG. 5, a second embodiment of a contact pin 34 includes two wire receiving recesses 36 to which the wire 30 is conductively secured. Recesses 36 each extend inwardly, prefereably radially, from the circumference of cylindrical pin 34. Wire 30 is connected to the recesses 36 by soldering or other conventional electrical attachment means.

A third embodiment of a contact pin for use as part of adapter 10 is illustrated in FIG. 6. Contact pin 40 is formed similarly to cylindrical contact pin 16, except that the pin recess 26 has been eliminated and the pin has a continuous cylindrical periphery. The elimination of the recess is made possible by the attachment of coiled spring 28 at the bottom of recess 14 to both the undersurface of the pin and the bottom of the recess. Spring 42 is welded, soldered or attached by other conventional means to the bottom of the pin by connection 44 and is either adhered, pinned, screwed or otherwise conventionally attached at its other end to the bottom of the recess, e.g., by pin 46. By providing for the attachment of spring 28 to both the pin and the recess, contact pin 40 will continuously remain within recess 14 and the need for the set screw, transverse pin bore and contact pin recess are eliminated.

A fourth embodiment of a contact pin which may be used as part of adapter 10 is illustrated in FIG. 7. Although the conical contact surface 18 of cylindrical contact pin 16 is preferred, as it provides a completely aligned electrical connection with a complimentary shaped contact, a cylindrical contact pin 52 may be used which has a flat, generally circular upper mating electrical contact surface 54. Such a pin can be used to matingly engage a corresponding mating contact pin 56 having a flat, generally circular complimentary shaped contact surface 58. Similarly, as illustrated in FIG. 8, a cylindrical contact pin 60 can be used which has an upper mating electrical contact surface in the form of a banana-clip type contact 62 which will matingly engage a mating contact pin 64 having a complimentary shaped mating contact surface 66. In both the embodiments of FIG. 7 and FIG. 8, the use of a screw and threaded screw bore for contact with a wire 30 would be impossible and as a result the wire receiving recesses 36 used in contact pin 34 are utilized to provide electrical contact with a wire 30. Although contact pins 52 and 60 are illustrated without a recess 26, such could be included to assist in retaining the pin if the block 12 is provided with a bore 31 and set screw 32, as shown in FIGS. 2 and 3.

The adapter of the present invention can be utilized whenever it is desired to provide superior electrical contact between elements in which it is normally difficult or impossible to align the electrical contact surfaces. As illustrated in FIG. 9, adapter 10' is shown used in conjunction with a conventional microswitch 70. The microswitch comprises a switch body 76 having an outwardly extending portion 78 trapezoidal in cross-section and contact pins 72 which have mating conical contact surfaces 74 formed at their tips. By simply dropping the switch into adapter 10', contacts 72 and 16 self-align with each other and insure a superior electrical connection between the switch and adapter. Adapter 10' is similar to adapter 10 but includes a slightly modified insulating block 48, which has a mating recess 50 of trapezoidal cross-sectional configuration corresponding to the trapezoidal outwardly extending portion 78 of microswitch 70.

As another example, the adapter of the present invention can be used in conjunction with a conventional wall outlet 82 as shown in FIG. 10. Wall outlet 82 includes an outlet plate 83 which bears against wall 80. Outlet plate 83 includes a plurality of contact pins 84 which have conical contact surfaces 86 for insertion into the moveable contact pins 16 which form part of adapter 10''. Adapter 10'' is similar to adapter 10 but has only two moveable contact pins connected therewith. Furthermore, as contact pins 84 and 85 have differently sized conical contact surfaces 86, the use of moveable contact pins 16 having variously sized conical contact surfaces 18 is necessitated. This is important to insure that plug-in outlet 82 can only be inserted into the adapter 10'' in one position, eliminating the possibility of a misconnection which could result in electrical shock. In all other respects, the adapter 10'' is similar to adapter element 10.

Any of the adapters of the present invention can be formed having at least two pins. If it is desired that a plurality of electrical circuits are to be created, as is the situation with microswitch 70 in which both on and off positions are desired, any greater number of electrical contact pins can be provided to receive a similar plurality of complimentary shaped electrical contacts from an external component.

In any of its uses, the adapter is configured so that when the plurality of complimentary shaped mating contacts on an external element are dropped, placed or otherwise engaged with the upper mating electrical contact surfaces of each of the moveable contact pins, each of the pins is downwardly displaced within recess 14, as illustrated in FIG. 3, until the spring 28 reacts against the initial displacement to upwardly bias each cylindrical contact pin 16 back toward its initial outwardly biased position, as illustrated by the dotted lines in FIG. 2. The springs 28 and complimentary shaped contacts 19 interact to align the contact pins 16, 17 and their corresponding mating contact surfaces 18, 19 and insure a superior electrical connection therebetween.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An electrical adapter capable of facilitating the installation of new electrical contacts and the repair of defective electrical contacts by insuring the aligned receipt of a plurality of complimentary shaped mating contacts by said adapter, said adapter comprising:

(a) a block of electrically insulating material having an upper surface, said block including a plurality of generally inverted conical recesses in said upper surface;

(b) electrically conductive contact pins positioned in at least two of said recesses, each of said pins having an initial position biased outwardly from said upper surface by a spring positioned beneath said pin along the bottom of each of said recesses, each of said pins including:

(i) an upper mating electrical contact surface; and (ii) connecting means for conductively securing said pin to a conductive wire, said connecting means including a longitudinal wire receiving bore extending through each of said pins beneath each of said contact surfaces;

(c) means for retaining each of said pins within each of said recesses, for limiting movement of each said pin within each said recess and for continuously maintaining said mating contact surface and said connecting means at a level above said upper surface of said block;

(d) a screw threaded bore extending from said upper mating contact surface to said receiving bore; and (e) a screw engageable within said threaded bore for securing a wire placed within said receiving bore, said adapter being configured so that when said plurality of complimentary shaped mating contacts is placed into engagement with said upper mating electrical contact surfaces, each of said pins will be downwardly displaced within a corresponding recess until the spring within each recess reacts against said displacement to upwardly bias each said pin towards said initial position, said springs and said complimentary shaped contacts interacting to align the complimentary contacts and mating surfaces and insure an electrical connection therebetween, said bore remaining at all times at a level above said upper surface of said block.

* * * * *